US007380957B2

(12) United States Patent
Lanczy

(10) Patent No.: US 7,380,957 B2
(45) Date of Patent: Jun. 3, 2008

(54) METHOD AND APPARATUS FOR JOINING LINEAR LIGHTING FIXTURES TO ELIMINATE SAG

(75) Inventor: Geza T. Lanczy, Auburn, IN (US)

(73) Assignee: Pent Technologies, Inc., Kendallville, IN (US)

( * ) Notice: Subject to any disclaimer, the term of this patent is extended or adjusted under 35 U.S.C. 154(b) by 118 days.

(21) Appl. No.: 11/327,951

(22) Filed: Jan. 9, 2006

(65) Prior Publication Data

US 2006/0158877 A1 Jul. 20, 2006

Related U.S. Application Data

(60) Provisional application No. 60/642,738, filed on Jan. 10, 2005.

(51) Int. Cl.
*F21S 4/00* (2006.01)

(52) U.S. Cl. ..... 362/219; 362/225; 362/457

(58) Field of Classification Search ..... 362/151, 362/152, 147, 219, 217, 457, 249, 404, 328, 362/225, 370
See application file for complete search history.

(56) References Cited

U.S. PATENT DOCUMENTS 2,383,007 A * 8/1945 Maurette ..... 362/457
2,625,646 A 1/1953 Goebel ..... 240/9
2,877,340 A * 3/1959 Spaulding ..... 362/362
3,011,047 A * 11/1961 Spaulding ..... 362/219
3,012,132 A 12/1961 Rosenfeld ..... 240/9
3,217,155 A 11/1965 Caferro et al. ..... 240/9
4,428,696 A * 1/1984 Price ..... 403/168
4,717,993 A 1/1988 Bernhart et al. ..... 362/219
4,726,781 A 2/1988 Bernhart et al. ..... 439/228
5,282,600 A 2/1994 Weiss et al. ..... 248/343
5,658,066 A 8/1997 Hirsch ..... 362/219
6,530,674 B2 3/2003 Grierson et al. ..... 362/219
6,568,830 B2 5/2003 Yaphe et al. ..... 362/219
6,796,676 B2 9/2004 Severtson et al. ..... 362/219

* cited by examiner

*Primary Examiner*—John Anthony Ward
*Assistant Examiner*—David R Crowe
(74) *Attorney, Agent, or Firm*—Taylor & Aust, P.C.

(57) ABSTRACT

A joiner assembly for joining and supporting a first linear light fixture with a second linear light fixture. The joiner assembly includes a joiner bracket including first control surface connected to a second control surface and a draw fastener hole therebetween. The first control surface is configured for controlling a position of the first linear light fixture in a prestressed condition, and the second control surface is configured for controlling a position of the second linear light fixture in a prestressed condition. A draw fastener is connected to the draw fastener hole. A draw fastener constraint is connected to the draw fastener and configured for connection to at least one of the first linear light fixture and the second linear light fixture.

17 Claims, 6 Drawing Sheets

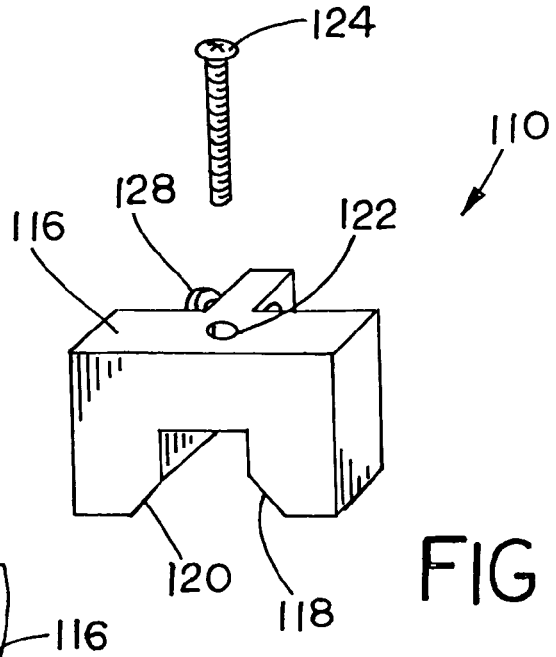
FIG 8
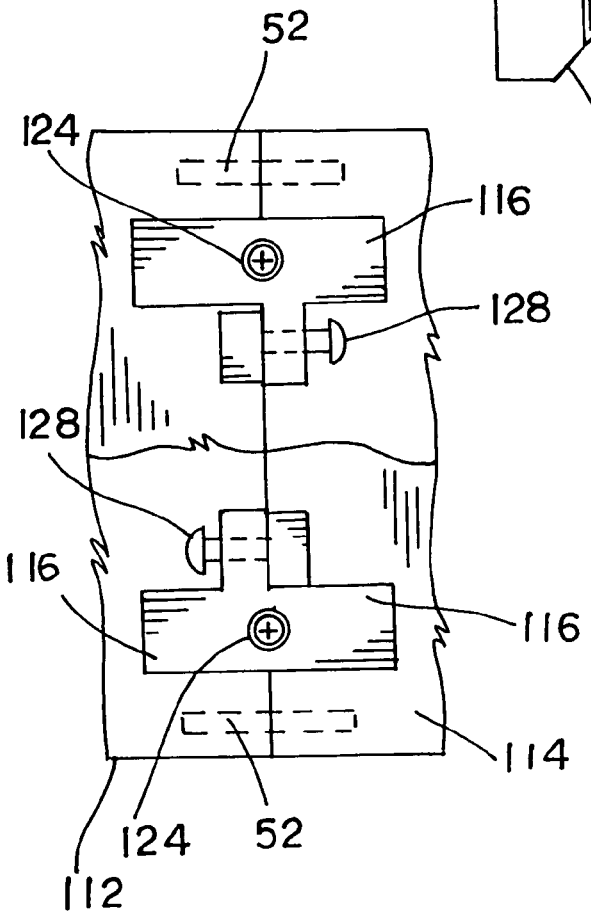
FIG. 9
FIG. 10
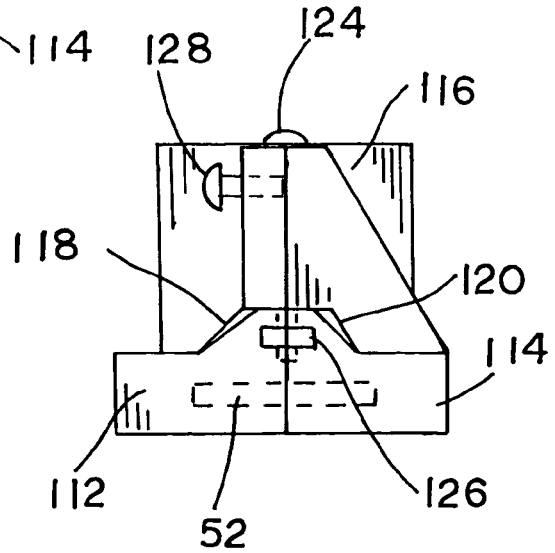

METHOD AND APPARATUS FOR JOINING LINEAR LIGHTING FIXTURES TO ELIMINATE SAG

CROSS REFERENCE TO RELATED APPLICATIONS

This is a non-provisional application based upon U.S. provisional patent application Ser. No. 60/642,738, entitled "METHOD OF JOINING RECTILINEAR LIGHTING FIXTURES TO ELIMINATE SAG", filed Jan. 10, 2005.

BACKGROUND OF THE INVENTION

1. Field of the Invention

The present invention relates to linear lighting fixtures, and, more particularly, to a method and apparatus for joining linear lighting fixtures to eliminate sag.

2. Description of the Related Art

Linear light fixtures are known which are suspended from a ceiling using a wire cable hangar, or other type of hangars, at each end of the fixture. Such fixtures are sometimes suspended end for end in a linear array or combination of fixtures. It is advantageous to minimize the number of hangars used in such a system, in order to save installation cost and time. However, sufficient hangars, and/or other structural support, must be present in order to maintain alignment of the adjoining fixtures, and also to provide sufficient structural support for the fixtures, and to eliminate any sagging of either of the fixtures. If one of the fixtures is misaligned or sags with respect to an adjoining fixture there is a less than an attractive look to the lighting system, which diminishes the aesthetic appeal of the lighting system. If the lighting system is not sufficiently structurally supported, and as the lighting fixtures can have relatively heavy metal housings which include the light source(s) and electrical components such as ballast systems, an insufficiently supported system can be a safety concern since such a system can potentially fall from the ceiling and a falling fixture is a hazard to people and/or property.

An apparatus and method for joining and aligning lighting fixture modules in an end-to-end relationship is known which utilizes paired interlocking connectors. The apparatus and method are suited for connecting fluorescent light modules which are suspended from a wall or ceiling, with minimal end-to-end distance between the ends of the fluorescent light tubes in adjacent modules. The connectors are placed at the ends of the modules, with a body portion of each connector adjacent a module end. Tapered tabs, joined to at least one body portion of each pair of connectors, are insertable through tapered openings in the body portion of the other connector in the pair to connect the two modules to each other. The tabs and openings are adapted for interconnection in at least two positions, including a first position for supporting an end of one of the modules while the module is hung and while electrical connections are made between the modules, and a second position where the tabs are fully inserted through the body portion of the adjacent connector to interlock the connectors. The tapered sides of the tabs and the openings aid in aligning the modules as the tabs are inserted through the openings. While this system may be adequate for aligning the ends of adjoining fixtures, it still requires a hangar for the adjoined ends (center) of the two fixtures, in order to sufficiently structurally support the two fixtures, and to eliminate any sagging in the center of the two fixtures. Therefore, only one of the four hangars are eliminated, the system still requiring three hangars, one at each end and one at the center.

A lighting system is known where individual fixture sections of a continuous row lighting assembly are joined together with end panels of adjacent sections abutting one another. The abutting end panels include registered apertures which carry an L-shaped fastener. Each fastener includes a first leg which engages the inner face of one end panel and a second leg having a threaded aperture which carries a screw. The screw is tightened to bear against the inner face of the other end panel to secure the fixture sections together in a continuous row. While this system may be adequate for aligning the ends of adjoining fixtures, it still requires a hangar for the adjoined ends (center) of the two fixtures, in order to sufficiently structurally support the two fixtures, and to eliminate any sagging in the center of the two fixtures. Therefore, only one of the four hangars are eliminated, the system still requiring three hangars, one at each end and one at the center.

What is needed in the art is an apparatus and method for joining and aligning lighting fixture which only requires two hangars, and which provides sufficient alignment and structural support for the adjoined fixtures while eliminating any sag of the fixtures.

SUMMARY OF THE INVENTION

The present invention provides a method and apparatus for joining linear lighting fixtures which includes a joiner bracket which spans an end of the first linear light fixture and an end of the second linear light fixture, and which uses a draw fastener to draw the two fixtures into a prestressed condition.

The invention comprises, in one form thereof, a joiner assembly for joining and supporting a first linear light fixture with a second linear light fixture. The joiner assembly includes a joiner bracket including first control surface connected to a second control surface and a draw fastener hole therebetween. The first control surface is configured for controlling a position of the first linear light fixture in a prestressed condition, and the second control surface is configured for controlling a position of the second linear light fixture in a prestressed condition. A draw fastener is connected to the draw fastener hole. A draw fastener constraint is connected to the draw fastener and configured for connection to at least one of the first linear light fixture and the second linear light fixture.

The invention comprises, in another form thereof, a linear lighting assembly, including a first linear light fixture, a second linear light fixture connected to the first linear light fixture, and a joiner assembly connected to the first linear light fixture and the second linear light fixture. The joiner assembly includes a joiner bracket including a first control surface connected to a second control surface and a draw fastener hole therebetween. The first control surface is connected to the first linear light fixture, and the second control surface is connected to the second linear light fixture. A draw fastener is connected to the draw fastener hole. A draw fastener constraint is connected to the draw fastener, and the draw fastener constraint is also connected to at least one of the first linear light fixture and the second linear light fixture.

The invention comprises, in yet another form thereof, a method of joining a first linear light fixture with a second linear light fixture in an end-to-end relationship, including the steps of: providing the first linear light fixture with the second linear light fixture in the end-to-end relationship so that an end of the first linear light fixture is adjacent an end the second linear light fixture; providing a joiner assembly including: a joiner bracket having a first control surface connected to a second control surface and a draw fastener hole therebetween, the first control surface connected to the first linear light fixture, the second control surface connected to the second linear light fixture, a draw fastener, and a draw fastener constraint connected to the draw fastener, the draw fastener constraint being connected to at least one of the first linear light fixture and the second linear light fixture; spanning the end of the first linear light fixture and the end the second linear light fixture with the joiner bracket; inserting the draw fastener into the draw fastener hole and the draw fastener constraint; and drawing the first linear light fixture and the second linear light fixture into a prestressed condition using the draw fastener.

An advantage of the present invention is that two linear light fixtures can be safely hung using only two hangars.

Another advantage of the present invention is that two linear light fixtures can be hung using only two hangars without any misalignment or sag between the linear light fixtures.

Yet another advantage of the present invention is that it saves time during installation.

Yet another advantage of the present invention is that it saves cost during installation.

Yet another advantage of the present invention is that it is more cost effective to manufacture.

Yet another advantage of the present invention is that it is easier to install in that it does not require adjusting a third hangar to eliminate sagging of the fixtures.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 8 is a perspective exploded view of another embodiment of a joiner assembly according to the present invention;

FIG. 9 is fragmentary top view of a joiner assembly/light fixture combination, shown with the joiner assembly of FIG. 8; and FIG. 10 is a side view of the joiner assembly and light fixtures of FIG. 9, as seen from a centerline of FIG. 9.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
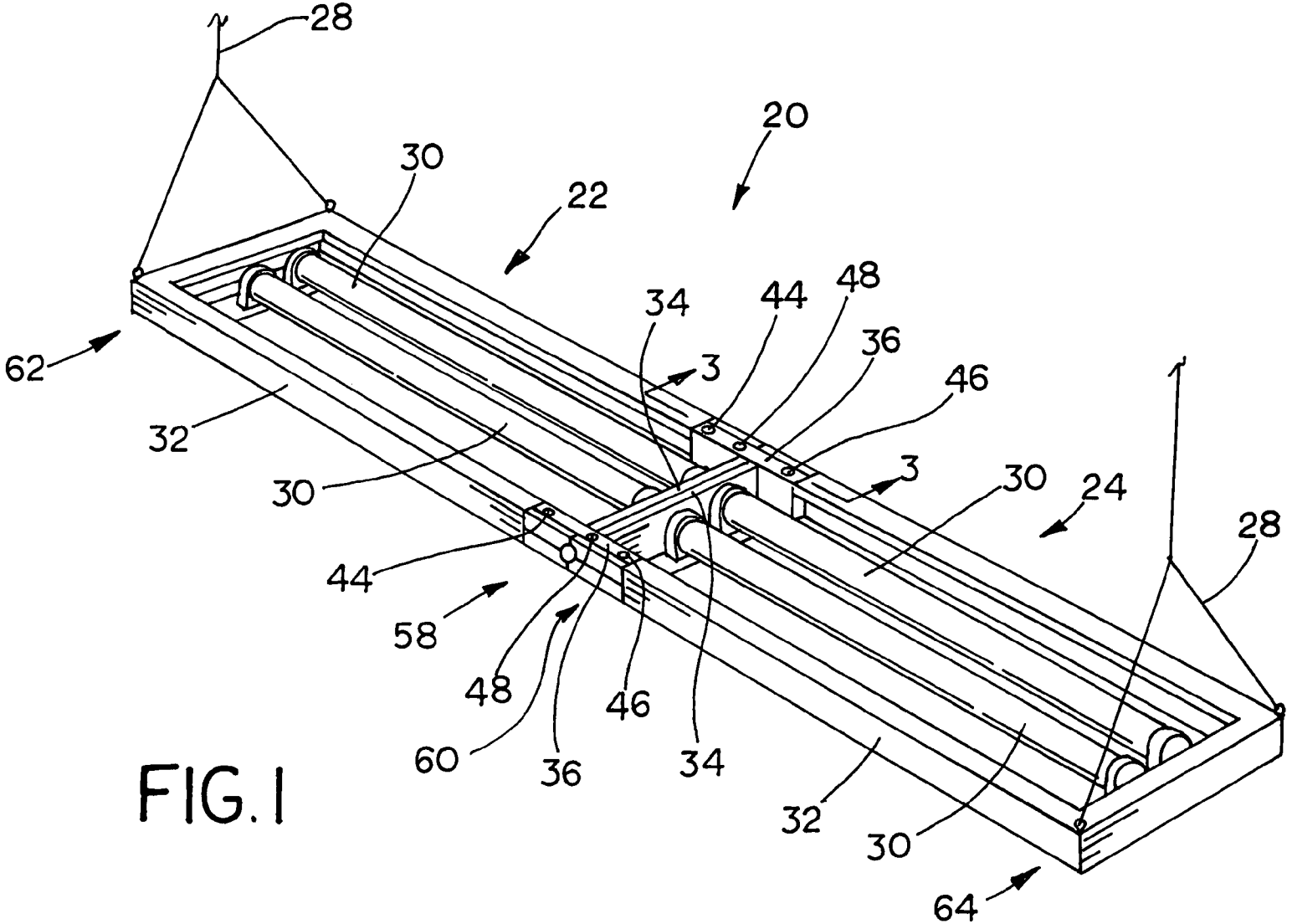
FIG. 1 is a perspective view of an embodiment of a linear lighting assembly according to the present invention.
Figure 2:
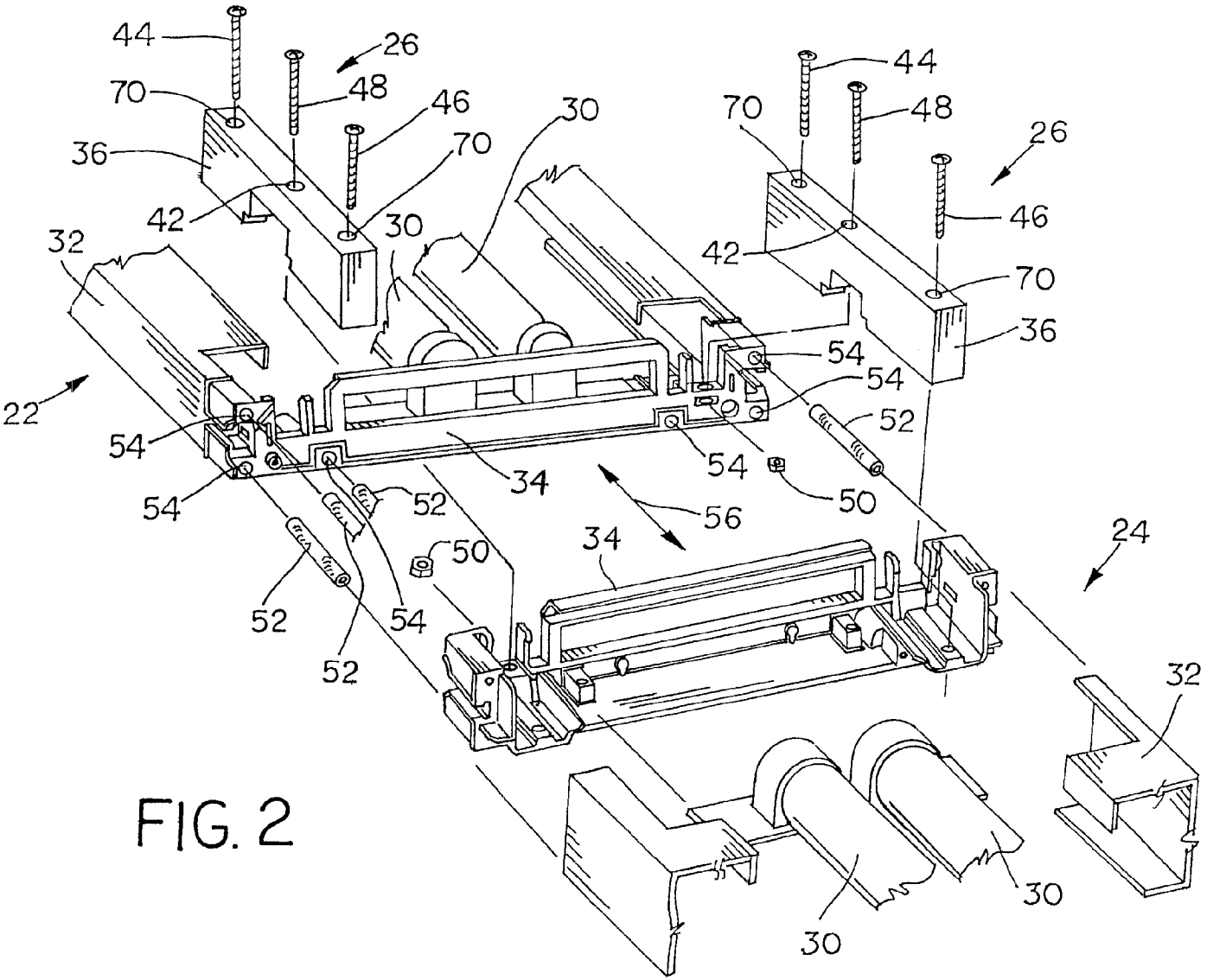
FIG. 2 is a fragmentary exploded view of the linear lighting assembly of FIG. 1.

Referring now to the drawings, and more particularly to FIGS. 1 and 2, there is shown a linear lighting assembly 20, which generally includes a first linear light fixture 22, a second linear light fixture 24 connected to first linear light fixture 22, at least one joiner assembly 26 connected to first linear light fixture 22 and second linear light fixture 24, and hangars 28.

Each of fixtures 22, 24 include a source of light, such as fluorescent lamps 30, although other sources of light such as incandescent, light emitting diode arrays, metal halide, sodium, and the like, can be used. Each of fixtures 22, 24 includes a fixture housing 32 connected to lamps 30. Housings 32 include respective end brackets 34. Each of fixtures 22, 24 are connected to a source of electrical power (not shown) and can include other electrical components such as ballasts, controls, conductors, connectors, and the like (also not shown) electrically connected to lamps 30 and as are required to electrically operate fixtures 22, 24. Additionally, each of fixtures 22, 24 can include other components such as diffusers, reflectors, lenses, filters, and the like (also not shown) which are connected to housings 32 and which work together with lamps 30 and housings 32 to provide a desired lighting effect.

In the embodiment shown, linear lighting assembly 20 includes two joiner assemblies 26. Each of joiner assemblies 26 includes a joiner bracket 36, shown more particularly in FIGS. 3-5, which includes a first control surface 38 connected to a second control surface 40 and a draw fastener hole 42 therebetween. First control surface 38 is connected to first linear light fixture 22, and more particularly to end bracket 34 of fixture 22, using anchor fastener 44 for example, where anchor fastener 44 can be a bolt or screw or other elements. Second control surface 40 is connected to second linear light fixture 24, and more particularly to end bracket 34 of fixture 22, using anchor fastener 46 for example, where anchor fastener 46 can be a bolt or screw or other elements. Anchor fasteners 44, 46 can connect to respective threaded holes in brackets 34, for example. A draw fastener 48, such as a bolt or screw or other elements, is inserted through draw fastener hole 42, and a draw fastener constraint 50, such as a nut or other element, is connected to draw fastener 48. Draw fastener constraint 50 is connected to, and more particularly is captive to, at least one of the end brackets 34 of first linear light fixture 22 and the second linear light fixture 24.

Figure 3:
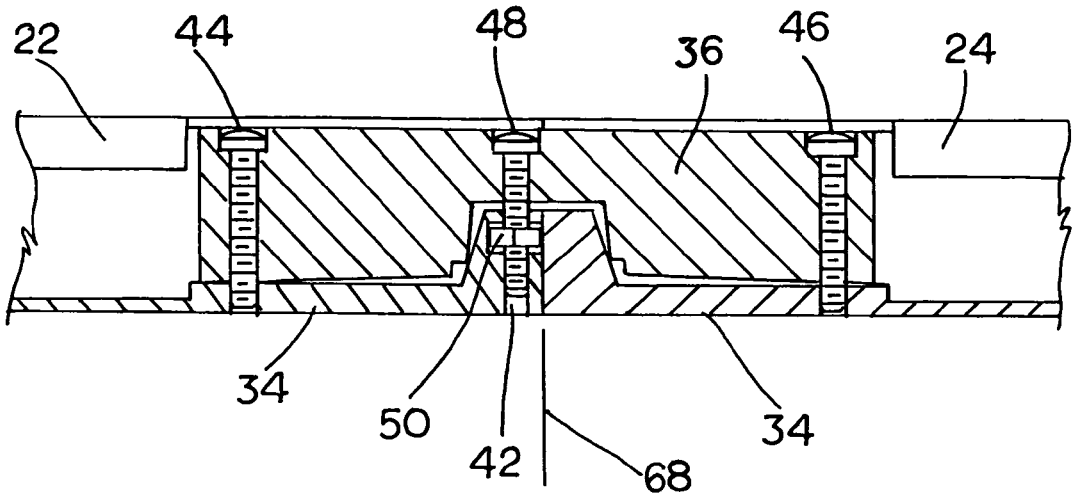
FIG. 3 is a cross-sectional view taken along section line 3-3 in FIG. 1, and illustrating a joiner assembly and the two light fixtures of FIG. 1 in an unstressed state.
Figure 4:
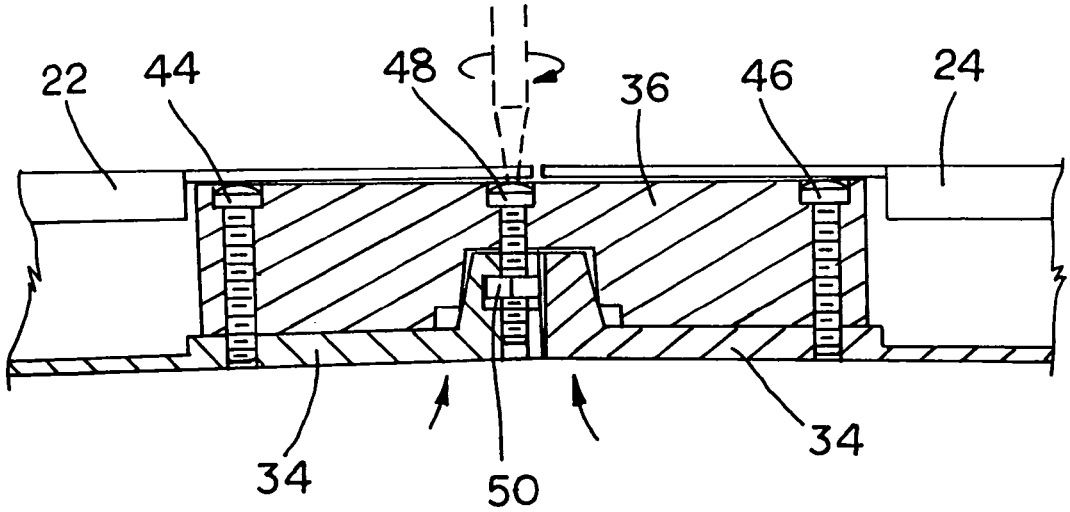
FIG. 4 is a cross-sectional view taken along section line 3-3 in FIG. 1, and illustrating the joiner assembly and the two light fixtures of FIG. 1 in a prestressed state.
Figure 5:
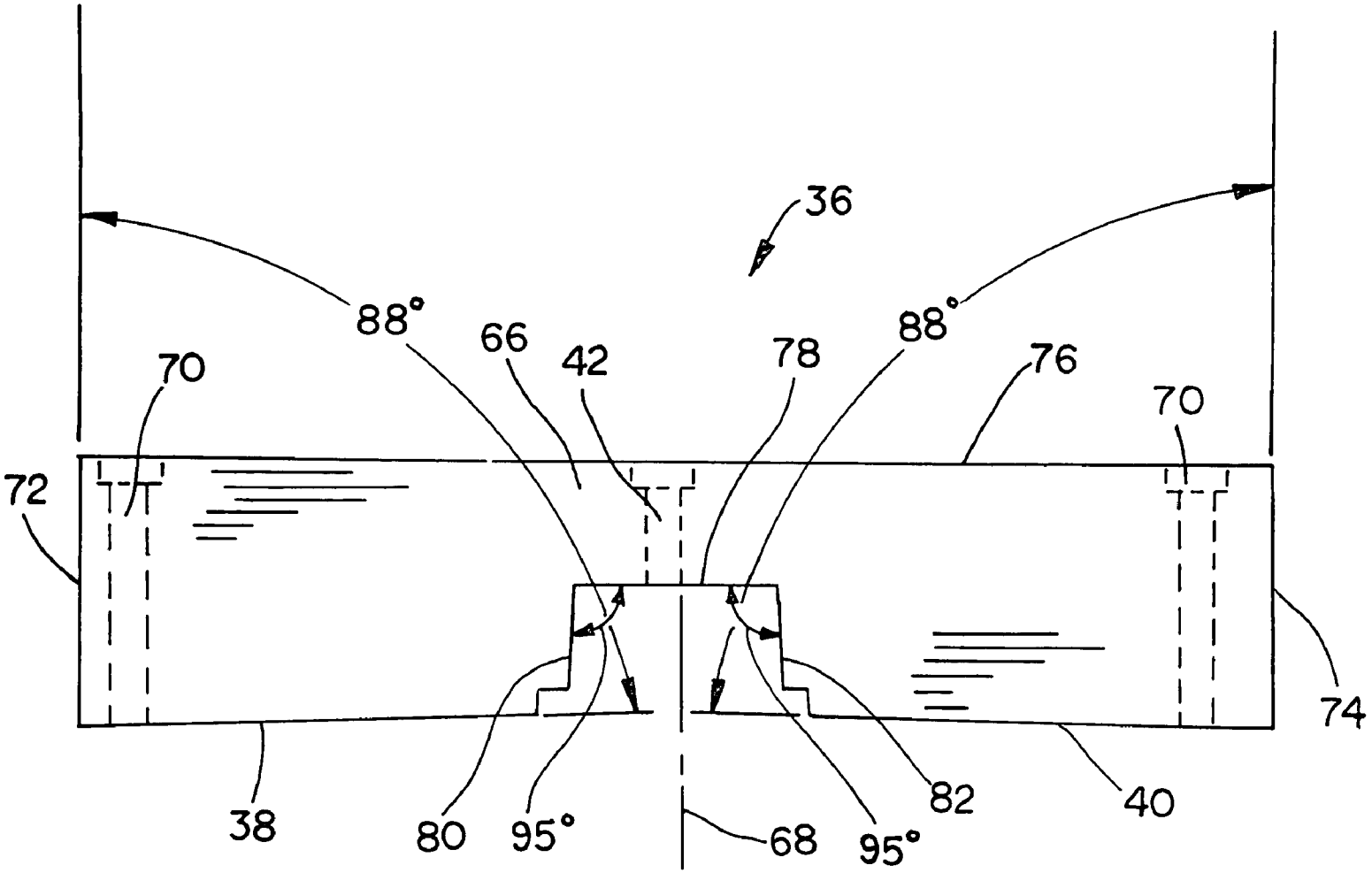
FIG. 5 is a side view of the joiner bracket of FIG. 1.

At least one spring pin 52 is connected to both respective end brackets 34 of first linear light fixture 22 and second linear light fixture 24. In the embodiment shown, six spring pins 52 (only four are shown) are inserted in respective spring pin holes 54 in both end brackets 34. Spring pins 52 can be tubular in construction and made of spring steel, so that they are relatively stiff but at the same time allow a small amount of deflection. Spring pins 52 are oriented in a longitudinal direction 56 of fixtures 22, 24. Although spring pins 52 are used in the embodiment shown, to interconnect end brackets 34 while still providing flexure between end brackets 34, other elements can be used to provide such interconnection between end brackets 34. FIG. 3 shows a cross-sectional view illustrating joiner assembly 26 and brackets 34 of light fixtures 22, 24 in an unstressed state. As draw fastener 48 is threaded into nut 50, and since nut 50 is captive relative to one of end brackets 34, and since end brackets 34 are interconnected using spring pins 52, both end brackets 34, and consequently adjacent ends 58, 60 of the housings 32 of respective fixtures 22, 24, are drawn up into a prestressed condition (FIG. 4). When linear lighting assembly 20 is hung from a ceiling using only two hangars 28 at respective opposite ends 62, 64 of fixtures 22, 24, compared to three or four hangars of the prior art, the prestressed upwardly deflected condition of adjacent ends 58, 60 is now counteracted by the portion of the weight of assembly 20 acting on the center of assembly 20 and thereby returns the center of assembly 20 to the level condition shown in FIG. 3. Spring pins 52 also provide a margin of safety for linear lighting assembly 20 in that if either of end brackets 34 fracture, and because pins 52 are snuggly fit into respective holes 54, the two fixtures 22, 24 remain connected at adjacent ends 58, 60, and assembly 20, or some part thereof, does not fall or come loose.

Joiner bracket 36 can include span 66 interconnecting first control surface 38 and second control surface 40, and draw fastener hole is located in span 66. Draw fastener hole 42 is located offset from a centerline 68 of span 66 so that a single design of joiner bracket 36 can be used on both edges of assembly 20 by simply reversing the orientation of joiner brackets 36, as shown in FIGS. 1 and 2. Anchor fasteners 44, 46 can be inserted into respective anchor through holes 70. Anchor through holes 70 are slightly oversized relative to anchor fasteners 44, 46 to allow for the slight movement of fasteners 44, 46 as end brackets 34 flex into the stressed condition. Joiner bracket 36 can include a first side surface 72 and a second side surface 74 opposite first side surface 72. First control surface 38 can be at approximately 88° to first side surface 72, and second control surface 40 can be at approximately 88° to second side surface 74. Control surfaces 38, 40 so configured to thereby limit the amount of upward deflection of adjacent ends 58, 60 to that required to just eliminate any sag when assembly 20 is hung using hangars 28. Further, joiner bracket 36 can include a top surface 76, a third control surface 78 approximately parallel to top surface 76, a fourth control surface 80 at approximately 95° to third control surface 78, and a fifth control surface 82 at approximately 95° to third control surface 78. With control surfaces 78, 80, 82 so configured joiner bracket 36 allows for the relative movement of end brackets 34, in prestressing and unstressing conditions and transitions, while still maintaining sufficient strength in joiner bracket 36.

In use, the present invention discloses a method of joining a first linear light fixture 22 with a second linear light fixture 24 in an end-to-end relationship, including the steps of: providing first linear light fixture 22 with second linear light fixture 24 in the end-to-end relationship so that an end 62 of first linear light fixture 22 is adjacent an end 60 second linear light fixture 24; providing a joiner assembly 26 as previously described; spanning end 58 of first linear light fixture 22 and end 60 second linear light fixture 24 with joiner bracket 26; inserting draw fastener 48 into draw fastener hole 42 and draw fastener constraint 50; and drawing first linear light fixture 22 and second linear light fixture 24 into a prestressed condition (FIG. 4) using draw fastener 48. The method of the present invention can include the further steps of connecting a first hangar 28 at an end 62 of first linear light fixture 22; connecting a second hangar 28 at an end 64 of second linear light fixture 24; and hanging fixtures 22, 24 using only the two hangars (FIG. 1).

Figure 6:
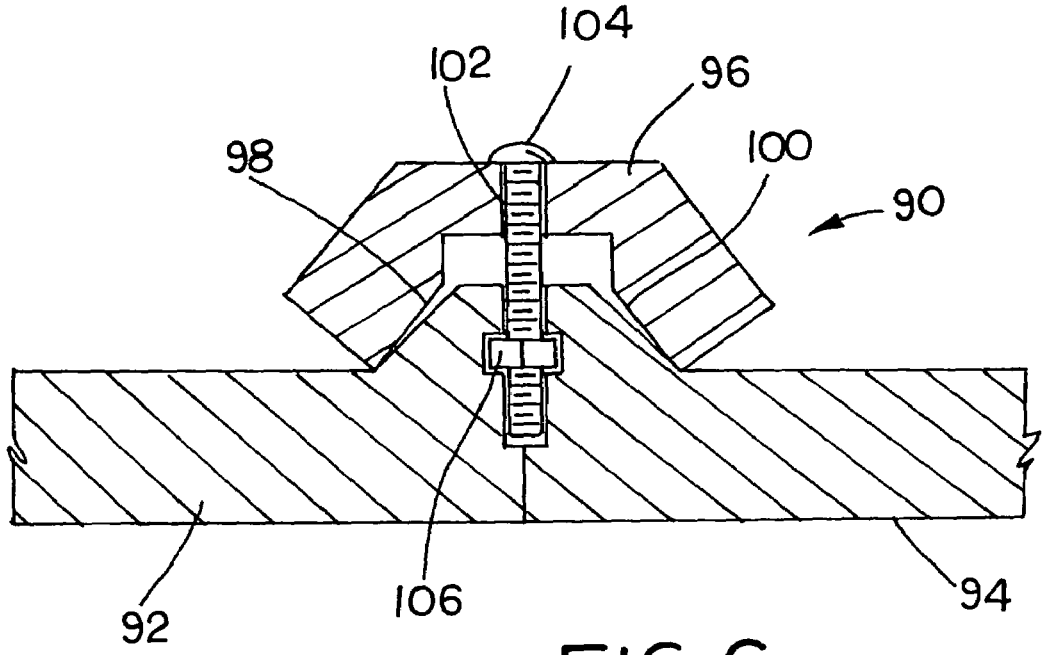
FIG. 6 is a cross-sectional view of another embodiment of a joiner assembly according to the present invention, and illustrating this embodiment of the joiner assembly and the two light fixtures in an unstressed state.
Figure 7:
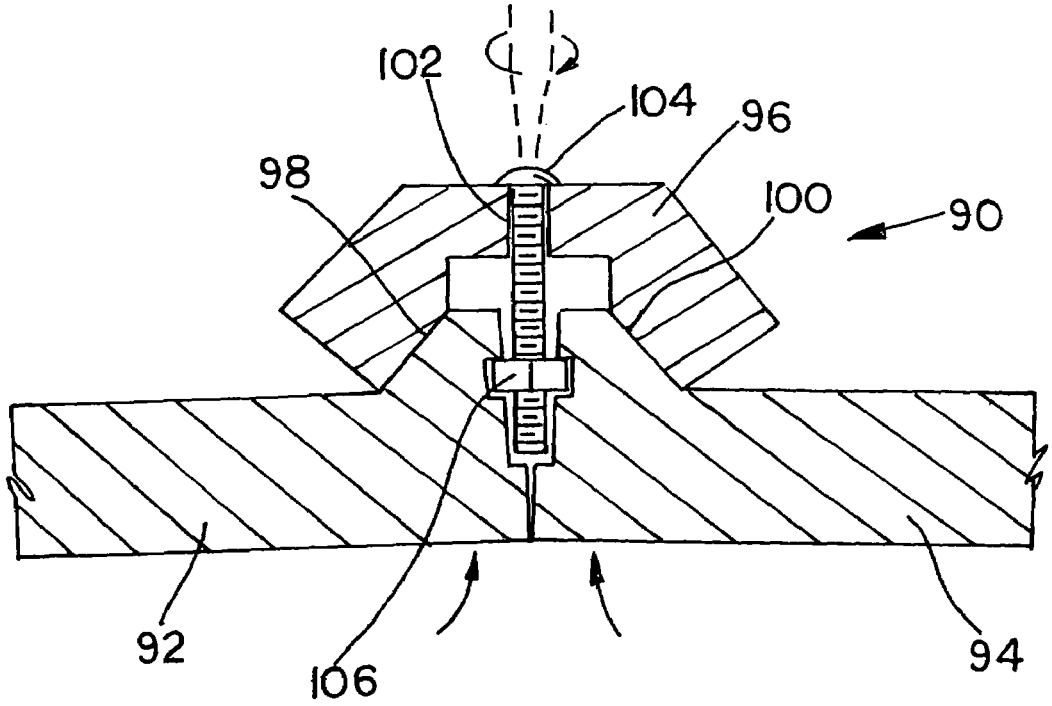
FIG. 7 is a cross-sectional view of the joiner assembly of FIG. 6, illustrating this embodiment of the joiner assembly and the two light fixtures in an prestressed state.

FIGS. 6 and 7 illustrate another embodiment of the joiner assembly of the present invention. Joiner assembly 90 is connected to respective ends of linear light fixtures 92, 94. Joiner assembly 90 includes a joiner bracket 96 with a first control surface 98 connected to a second control surface 100 and a draw fastener hole 102 therebetween. Control surfaces 98, 100 are connected to respective fixtures 92, 94. A draw fastener 104 is connected to draw fastener hole 102. A draw fastener constraint 106 is connected to draw fastener 104. Draw fastener constraint 106 is also connected to fixture 92 and/or fixture 94. Fixtures 92 and 94 can be connected with spring pins 52.

FIGS. 8-10 illustrate another embodiment of the joiner assembly of the present invention. Joiner assembly 110 is connected to respective ends of linear light fixtures 112, 114. Joiner assembly 110 includes a joiner bracket 116 with a first control surface 118 connected to a second control surface 120 and a draw fastener hole 122 therebetween. Control surfaces 118, 120 are connected to respective fixtures 112, 114. A draw fastener 124 is connected to draw fastener hole 122. A draw fastener constraint 126 is connected to draw fastener 124. Draw fastener constraint 126 is also connected to fixture 112 and/or fixture 114. Joiner bracket 116 can be connected to at least one of linear light fixtures 112, 114 using anchor fastener 128, for example. Fixtures 112 and 114 can be connected with spring pins 52.

Either one of the embodiments of FIGS. 6-7 and 8-10 can also be used with the method of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A joiner assembly for joining and supporting a first linear light fixture with a second linear light fixture, said joiner assembly comprising:

a joiner bracket including first control surface connected to a second control surface and a draw fastener hole therebetween, said first control surface configured for controlling a position of the first linear light fixture in a prestressed condition, said second control surface configured for controlling a position of the second linear light fixture in a prestressed condition;

a draw fastener connected to said draw fastener hole; and a draw fastener constraint threadably connected to said draw fastener and configured for connection to at least one of the first linear light fixture and the second linear light fixture, said joiner bracket, said draw fastener, and said draw fastener constraint being configured for cooperatively deflecting upwardly adjacent ends of the first and second linear light fixtures so as to eliminate a sag of the first and second linear light fixtures without positioning a hangar on either of said adjacent ends of the first and second linear light fixtures.

2. The joiner assembly of claim 1, wherein said joiner bracket includes a span interconnecting said first control surface and said second control surface, said draw fastener hole is located in said span.

3. The joiner assembly of claim 2, wherein said draw fastener hole is located offset from a centerline of said span.

4. The joiner assembly of claim 3, wherein the joiner assembly includes only one draw fastener, only one draw fastener constraint, and only one draw fastener hole.

5. The joiner assembly of claim 1, wherein said span includes a first anchor hole on one side of said draw fastener hole and a second anchor hole on another side of said draw fastener hole.

6. The joiner assembly of claim 1, wherein said joiner bracket includes a first side surface and a second side surface opposite said first side surface, said first control surface is at approximately 88° to said first side surface, and said second control surface is at approximately 88° to said second side surface.

7. The joiner assembly of claim 1, wherein said joiner bracket includes a top surface, a third control surface approximately parallel to said top surface, a fourth control surface at approximately 95° to said third control surface, and a fifth control surface at approximately 95° to said third control surface.

8. A linear lighting assembly, comprising:

a first linear light fixture;

a second linear light fixture connected to said first linear light fixture;

a joiner assembly connected to said first linear light fixture and said second linear light fixture and configured for deflecting upwardly adjacent ends of said first and second linear light fixtures so as to eliminate a sag of the first and second linear light fixtures without positioning a hangar on either of said adjacent ends of said first and second linear light fixtures, said joiner assembly including:

a joiner bracket including a first control surface connected to a second control surface and a draw fastener hole therebetween, said first control surface connected to said first linear light fixture, said second control surface connected to said second linear light fixture;

a draw fastener connected to said draw fastener hole; and a draw fastener constraint threadably connected to said draw fastener, said draw fastener constraint being connected to at least one of the first linear light fixture and the second linear light fixture.

9. The linear lighting assembly of claim 8, wherein said joiner bracket includes a span interconnecting said first control surface and said second control surface, said draw fastener hole is located in said span.

10. The linear lighting assembly of claim 9, wherein said draw fastener hole is located offset from a centerline of said span.

11. The linear lighting assembly of claim 8, wherein said span includes a first anchor hole on one side of said draw fastener hole and a second anchor hole on another side of said draw fastener hole.

12. The linear lighting assembly of claim 11, further including a first anchor fastener connected to said first linear light fixture and a second anchor fastener connected to said second linear light fixture.

13. The linear lighting assembly of claim 8, wherein said joiner bracket includes a first side surface and a second side surface opposite said first side surface, said first control surface is at approximately 88° to said first side surface, and said second control surface is at approximately 88° to said second side surface.

14. The linear lighting assembly of claim 8, wherein said joiner bracket includes a top surface, a third control surface approximately parallel to said top surface, a fourth control surface at approximately 95° to said third control surface, and a fifth control surface at approximately 95° to said third control surface.

15. The linear lighting assembly of claim 8, further including at least one spring pin connected to said first linear light fixture and said second linear light fixture, said at least one spring pin oriented in a longitudinal direction of said first linear light fixture and said second linear light fixture.

16. A method of joining a first linear light fixture with a second linear light fixture in an end-to-end relationship, comprising the steps of:

providing said first linear light fixture with said second linear light fixture in said end-to-end relationship so that an end of said first linear light fixture is adjacent an end of said second linear light fixture;

providing a joiner assembly including: a joiner bracket having a first control surface connected to a second control surface and a draw fastener hole therebetween, said first control surface connected to said first linear light fixture, said second control surface connected to said second linear light fixture; a draw fastener; and a draw fastener constraint threadably connected to said draw fastener, said draw fastener constraint being connected to at least one of the first linear light fixture and the second linear light fixture;

spanning said end of said first linear light fixture and said end of said second linear light fixture with said joiner bracket;

inserting said draw fastener into said draw fastener hole and said draw fastener constraint; and drawing said first linear light fixture and said second linear light fixture into a prestressed upwardly deflected condition using said draw fastener so as to eliminate any sag of said first and second linear light fixtures without positioning a hangar on either of said ends of said first and second linear light fixtures.

17. The method of claim 16, further including the steps of connecting a first hangar at an end of said first linear light fixture opposite said adjacent ends of said first linear light fixture and said second linear light fixture; connecting a second hangar at an end of said second linear light fixture opposite said adjacent ends of said first linear light fixture and said second linear light fixture; and hanging said first linear light fixture and said second linear light fixture using only said first hangar and said second hangar.

* * * * *